US012305513B2

(12) United States Patent
Hvidsten et al.

(10) Patent No.: US 12,305,513 B2
(45) Date of Patent: May 20, 2025

(54) RIGLESS DRILLING AND WELLHEAD INSTALLATION

(71) Applicant: Vetco Gray Scandinavia AS, Nailsea (GB)

(72) Inventors: Jarle Hvidsten, Laksevåg (NO); Knut Inge Dahlberg, Blomsterdalen (NO); Anders Berggren, Blomsterdalen (NO); Vidar Strand, Sandnes (NO)

(73) Assignee: Vetco Gray Scandinavia AS (NO)

( * ) Notice: Subject to any disclaimer, the term of this patent is extended or adjusted under 35 U.S.C. 154(b) by 0 days.

(21) Appl. No.: 18/409,919

(22) Filed: Jan. 11, 2024

(65) Prior Publication Data

US 2024/0141731 A1 May 2, 2024

Related U.S. Application Data

(63) Continuation of application No. 17/310,569, filed as application No. PCT/EP2020/025077 on Feb. 18, 2020, now Pat. No. 11,905,831.

(30) Foreign Application Priority Data

Feb. 18, 2019 (NO) ..... 20190220

(51) Int. Cl.
*E21B 7/124* (2006.01)
*B63B 35/44* (2006.01)
(Continued)

(52) U.S. Cl.
CPC ..... *E21B 7/128* (2013.01); *B63B 35/4413* (2013.01); *E21B 7/124* (2013.01); *E21B 7/20* (2013.01); *E21B 15/02* (2013.01); *E21B 21/001* (2013.01); *E21B 33/035* (2013.01); *E21B 33/05* (2013.01)

(58) Field of Classification Search
CPC . E21B 7/124; E21B 7/128; E21B 7/20; E21B 15/02; E21B 21/001; E21B 33/035; E21B 33/05; B63B 35/4413
See application file for complete search history.

(56) References Cited

U.S. PATENT DOCUMENTS 3,129,774 A * 4/1964 Armstrong ..... E21B 7/128 175/7
3,732,143 A * 5/1973 Joosse ..... E21B 7/124 175/6

(Continued)

FOREIGN PATENT DOCUMENTS

GB 2572310 B 2/2022
NO 320829 B1 1/2006

(Continued)

OTHER PUBLICATIONS

Notice of Allowance issued in U.S. Appl. No. 17/310,569, dated Oct. 19, 2023.

(Continued)

*Primary Examiner* — Matthew R Buck

(74) *Attorney, Agent, or Firm* — Baker Hughes Patent Organization

(57) ABSTRACT

The present invention relates to methods and systems for establishing a well foundation as well as for drilling and installation of a surface casing without any use of a drilling rig.

18 Claims, 12 Drawing Sheets

(51) Int. Cl.

| | |
|---|---|
| ***E21B 7/128*** | (2006.01) |
| ***E21B 7/20*** | (2006.01) |
| ***E21B 15/02*** | (2006.01) |
| ***E21B 21/00*** | (2006.01) |
| ***E21B 33/035*** | (2006.01) |
| ***E21B 33/05*** | (2006.01) |

(56) References Cited

U.S. PATENT DOCUMENTS

| | | | | |
|---|---|---|---|---|
| 4,813,496 | A * | 3/1989 | Rohweller | E21B 7/208 175/171 |
| 4,904,119 | A * | 2/1990 | Legendre | E21B 10/345 175/57 |
| 6,386,291 | B1 * | 5/2002 | Short | E21B 34/04 166/88.1 |
| 9,038,732 | B2 * | 5/2015 | Eikemo | E21B 21/001 166/351 |
| 9,816,331 | B2 * | 11/2017 | Le | E21B 7/20 |
| 11,008,811 | B2 * | 5/2021 | Wijning | E21B 7/208 |
| 11,905,831 | B2 * | 2/2024 | Hvidsten | E21B 41/0007 |
| 2008/0226398 | A1 * | 9/2008 | Gibberd | F03B 13/264 405/223 |
| 2009/0078424 | A1 * | 3/2009 | Carossino | E21B 4/04 166/341 |
| 2011/0017511 | A1 * | 1/2011 | Payne | E21B 21/08 175/7 |

FOREIGN PATENT DOCUMENTS

| | | | | |
|---|---|---|---|---|
| NO | 346793 | A1 | 8/2018 | |
| WO | 2007042830 | A1 | 4/2007 | |
| WO | 2011023745 | A1 | 3/2011 | |
| WO | WO-2013167872 | A2 * | 11/2013 | E21B 23/00 |
| WO | 2018143824 | A1 | 8/2018 | |
| WO | 2019022601 | A1 | 1/2019 | |

OTHER PUBLICATIONS

Final Office Action issued in U.S. Appl. No. 17/310,569, dated Jan. 3, 2023.

Non-Final Office Action issued in U.S. Appl. No. 17/310,569, dated Apr. 22, 2022.

* cited by examiner

RIGLESS DRILLING AND WELLHEAD INSTALLATION

CROSS-REFERENCE TO RELATED APPLICATIONS

This application is a continuation of U.S. patent application Ser. No. 17/310,569 filed Aug. 11, 2021, which is national stage entry of PCT Application No. PCT/EP2020/025077 filed Feb. 18, 2020, which claims priority to Norwegian Application No. 20190220 filed Feb. 18, 2019, all of which are incorporated by reference herein in their entirety for all intents and purposes.

BACKGROUND

The present invention relates to methods and systems for establishing a well foundation as well as drilling and installation of a surface casing without use of a drilling rig. More specifically it relates to methods for establishing a well foundation subsea using a vessel instead of a drilling rig.

When oil fields are established on the seabed, it is common practice to place a drilling rig at the oil field and do the drilling of wells from this drilling rig. The rigs are stable and provided with equipment to compensate for wind and waves to ensure the well drilling process is performed in a controlled way.

However, drilling with a drilling rig is expensive due to high day rates. It can also be time consuming, as the rig has to be transported to the field and anchored up before drilling can start. Delays may happen due to weather conditions or other unexpected incidents during transport and anchoring of the rig. It is also to some extent overkill to establish a drilling rig for some parts of the operation, especially the first part of the process when the well foundation is established. This initial well establishing process can be drilled in open water without any well control.

After years with large oil fields at acceptable depths and relatively close to land, the focus is now more on smaller fields which also can be more remotely placed as the development in petroleum technology makes is possible and viable to explore these options. At the same time, there is an increase in smaller oil companies trying to enter the petroleum marked by taking over oil fields with presumed marginal income expectations.

The development of smaller fields in more demanding environment also increases the focus on simplification and cost savings. In this context, there is a need to look at the drilling operation, which present a substantial cost even before production has started. This can be an unaffordable obstacle especially for smaller companies or marginal fields.

A further problem that can arise during establishment of a well is release of shallow gas.

It is therefore an object of the present invention to provide methods and systems that will reduce the total cost of a well, thereby enabling exploitation of fields previously regarded as not viable.

Another object of the invention is to provide for a quick escape of an installation vessel in an event of release of shallow gas.

Another object of the invention is to provide a method for establishing well foundation, as well as drilling and installation of a surface casing using a vessel, and thereby without any use of a drilling rig.

Yet another object of the invention is to provide systems for establishing well foundation, as well as for drilling and installation of a surface casing without use of a drilling rig.

According to a first aspect of the present invention, this is achieved with methods using a vessel, and not a rig, for establishing well foundation, and for drilling and installation of a surface casing.

According to a second aspect of the invention, this is achieved with systems using such methods.

The main features of the present invention are given in the independent claims. Additional features of the invention are given in the dependent claims.

A method for establishing a well foundation without use of a drilling rig can comprise the following steps:

- A subsea node, such as e.g. a suction anchor or a subsea template, is installed as a foundation during a rig-less installation and/or drilling operation;
- A bottom hole assembly (BHA) having a drill bit motor and a kelly bushing adapter allows a non-rotating or kelly pipe or string to travel freely up and down (i.e. to freely travel axially) and prevents it from rotation; here a kelly pipe is a pipe that is not round in order to prevent rotation. The kelly bushing adapter allows the kelly pipe to freely travel axially, but prevents it from rotation. The kelly bushing adapter can be configured to lock into one from the group consisting of: a suction anchor, a low pressure housing and/or a high pressure housing. As mentioned before, at this stage, the bottom hole assembly (BHA) above the drill motor can move freely axially, but will not rotate.
- The non-rotating or kelly pipe or string and the kelly bushing adapter transfer the reactive torque produced from the rotating drill bit to the subsea node (e.g. the suction anchor) and into the seabed.

A herein described method for establishing a well foundation and drilling of a borehole using a vessel comprise:

- preinstalling a subsea node on a seabed;
- lowering a set of a bottom hole assembly, a kelly busing adapter and a non-rotating drill string from the vessel down into the sea using hoisting means on the vessel;
- setting the bottom hole assembly into the subsea node;
- coupling the bottom hole assembly to the subsea node using the kelly busing adapter, the kelly bushing adapter having a locking mechanism locking the kelly busing adapter to the subsea node or a housing such as a high pressure housing or a low pressure housing, ensuring vertical movement and preventing rotation of at least the bottom hole assembly;
- setting weight in bottom hole assembly,
- pumping a fluid from a pump on the vessel or on the seabed through a hose into the bottom hole assembly and down a non-rotating string in order to drive a drilling motor of the bottom hole assembly,
- drilling the borehole by means of the drilling motor.

The kelly bushing adapter can also ensure vertical movement and prevent rotation of the non-rotating drill string.

The described method can also comprise one of the steps of

- pulling the bottom hole assembly back to the vessel using the hoisting means on the vessel or
- sacrificing the bottom hole assembly in the well, when a desired depth of the borehole is reached.

The described method can also comprise the step of:

- returning drill cuttings escape through cement return ports in the subsea node. In the described method, the bottom hole assembly is comprising a drill bit, the drilling motor, the non-rotating string, a side entry sub and a lifting sub.

The hoisting means may comprise a cable and a crane or winch.

In some aspects of the method, the pulling back step comprises:

unlocking the kelly bushing adapter by opening the locking mechanism when the drilling motor reaches the kelly bushing adapter;

pulling the bottom hole assembly further up thus freeing the kelly bushing adapter from the low pressure housing; and pulling the bottom hole assembly further up to the water surface by using the hoisting means on the vessel, thus leaving the drilled borehole ready for running a surface casing or low pressure housing with outer conductor piping thereafter.

In some aspects, the method further comprises:

adjusting the weight on the drill bit by a hive compensating equipment arranged on the vessel or bottom hole assembly and cooperating with the crane or winch on the vessel.

It is also described a method for installation of a surface casing using a vessel, the method comprising:

preparing a well casing assembly, a high pressure housing (HPH) running tool, a cement stinger, a high pressure housing (HPH) side entry sub and a high pressure housing (HPH) lifting sub into one unit onshore or on a vessel;

connecting a hose from the vessel to the side entry sub of the surface casing assembly;

dispatching the well casing assembly from the vessel;

lowering the well casing assembly by means of a crane or winch on the vessel;

stabbing the well casing assembly into the low pressure housing and running it into the borehole supported by the wire;

latching and locking the high pressure housing of the well casing assembly into the low pressure housing;

cementing the well casing in place by pumping cement from the vessel, through the hose, into the side entry sub, through the HPH running tool and down and out of the cement stinger;

releasing the HPH running tool and pulling out of the borehole together with the lifting sub, the side entry sub and the cement stinger by using the hoisting means on the vessel.

In this method, the well casing assembly may be a surface casing assembly comprising a high pressure housing and a surface casing or a conductor assembly comprising low pressure housing and outer conductor piping.

In a described method for installation of a surface casing using a vessel, cement returns are coming back out through a check valve of the surface casing, along outside of the surface casing assembly, and finally the cement returns go out through ports in the low pressure housing.

It is also described a system for establishing a well foundation and drilling of a borehole using a vessel, the system comprising:

a subsea node comprising a low pressure housing and configured to be preinstalled on a seabed;

a bottom hole assembly comprising a drill bit, a drilling motor, a kelly bushing adapter, a non-rotating string, a side entry sub and a lifting sub and configured to be lifted from a vessel and lowered down into the sea by means of a hoisting means on the vessel; where the bottom hole assembly is configured to be set into the subsea node with the low pressure housing;

a locking mechanism configured to lock and unlock the kelly bushing adapter to one from the group consisting of: the low pressure housing, a suction anchor and a high pressure housing; and a pump being configured to pump a fluid through a hose into the side entry sub and down the non-rotating string in order to drive the drilling motor in order to drill a desired depth of the borehole.

In the system the pump may be configured to be arranged on the vessel or on the seabed. the locking mechanism may be configured to be operated by an ROV.

In the above system for establishing a well foundation and drilling of a borehole using a vessel, the system may further comprise a hive compensating equipment being arranged on the vessel and configured to cooperate with the crane thereon in order to be adjusting the weight on the drill bit.

It is also described a system for installation of a surface casing using a vessel, the system comprising:

a surface casing assembly comprising a high pressure housing, a surface casing, a HPH running tool, a cement stinger, a HPH side entry sub and a HPH lifting sub, where the surface casing assembly is configured to be dispatched from a vessel and then lowered down on a wire of a crane on the vessel and is further configured to be stabbed into a subsea node with a low pressure housing and to be run into a borehole on the wire; and a hose from the vessel and connected to the side entry sub of the surface casing assembly;

wherein the high pressure housing of the surface casing assembly is configured to be locked into the low pressure housing;

wherein the cement stinger is configured to cement the surface casing in place in the borehole by means of a pump configured to pump cement from the vessel, through the hose, into the side entry sub and through the HPH running tool; and wherein the HPH running tool is configured to be released and pulled out of the borehole together with the lifting sub, the side entry sub and the cement stinger by using the wire of the crane on the vessel.

These and other aspects of the invention are apparent from and will be further elucidated, by way of example(s), with reference to the drawings, wherein.

Figure 1:
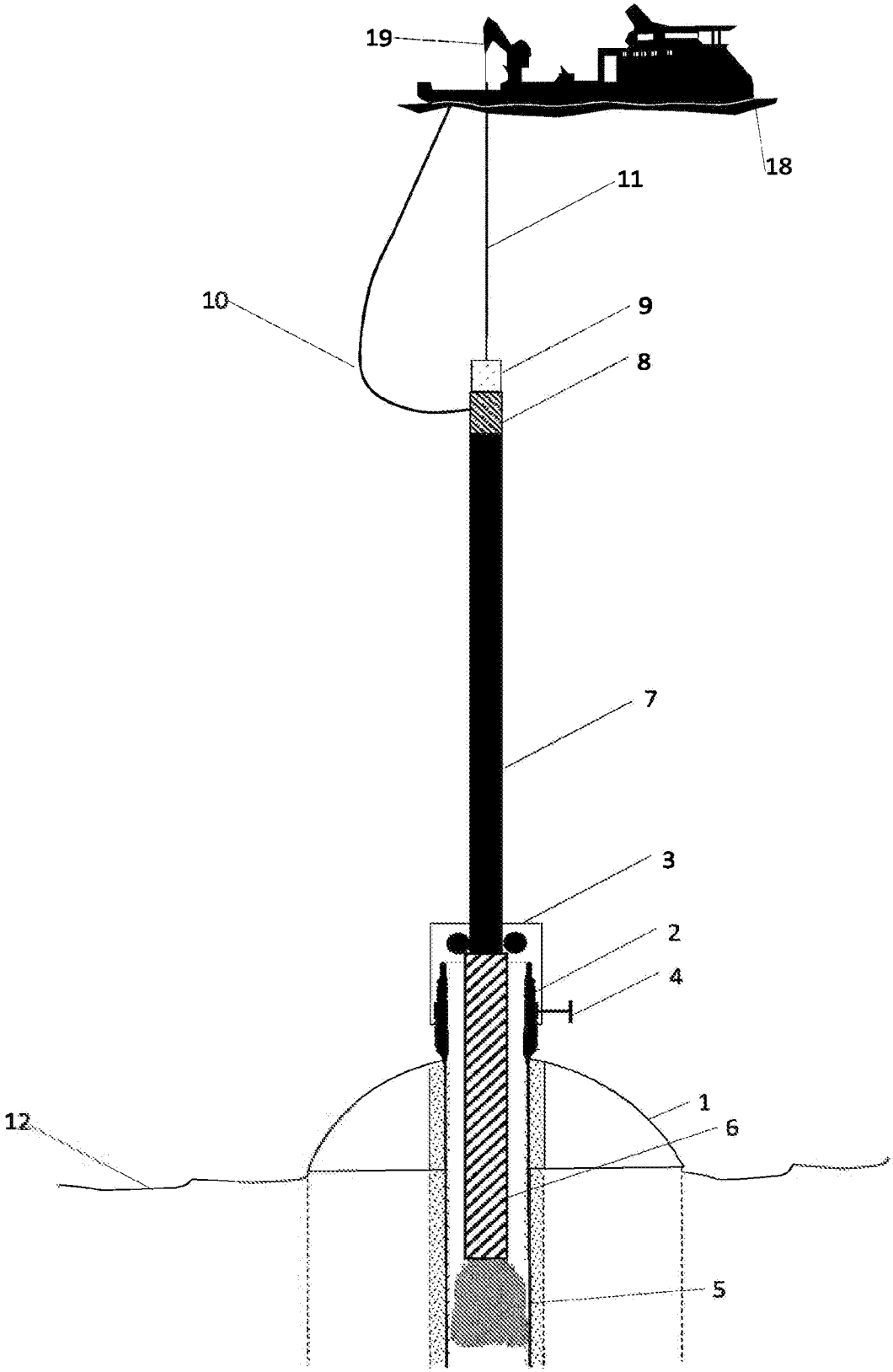
FIG. 1-5 show a well hole drilling method according to the present invention.

A subsea node 1 is provided for the drilling method. The subsea node 1 forms an outer protective casing for the drilling equipment and will provide a means for anchoring drilling equipment and/or well foundation to the seabed. The subsea node 1 is typically completed with a wellhead assembly comprising an outer well housing or low pressure housing (LPH) 2 and an inner well housing or high pressure housing (not shown). The outer well housing 2 can be provided with an outer conductor piping 32. The subsea node 1 can be completed with the wellhead assembly prior to or after completion of the well drilling.

The subsea node 1 is preinstalled in a separate operation on a seabed 12. The completion of the subsea node 1 with the low pressure housing (LPH) 2 is often done onshore prior to any other offshore operation while the high pressure housing (not shown) is installed after drilling of the first section of the well.

It is possible to drill the first section of the well without BOP. However, when the well is approaching high pressure subterranean structures, a BOP has to be installed on the subsea node 1.

Drilling at first a part of a well 20 with a vessel 18 and without a BOP, will reduce the cost of each well by limiting the rig time for well drilling and simplify the structure requirement for this first drilling part. Thereafter a rig can arrive and install the BOP directly at a preinstalled wellhead. It is also a safe method as the vessel 18 doesn't need to be straight above the well centre and can easily escape in an event of release of shallow gas.

FIG. 1:

An onshore preassembled drilling assembly according to the present invention comprises a bottom hole assembly (BHA) 5. This BHA 5 can typically comprise a drill bit with stabilizers, a drilling motor, which can be, but is not limited to, for example a drilling motor 6, a kelly bushing adapter 3, a non-rotating or non-circular string or pipe 7, which can be, but is not limited to, for example one piece of a kelly string, a side entry sub 8 with a swivel and a lifting sub 9.

The drilling assembly is lifted into the sea and lowered down on a cable 11 of a vessel crane 19 into the subsea node 1 and the LPH 2. In this context, the cable 11 can be a cable, wire, rope or chain.

The BHA 5 is lowered into the subsea node 1 and the kelly bushing adapter 3 is locked to the subsea node 1. And more particularly, torque keys of the kelly bushing adapter 3 are aligned with the subsea node 1 and then the kelly bushing adapter 3 is locked to the low pressure housing or well housing 2 using a locking mechanism 4. When the kelly bushing adapter 3 is locked to the subsea node 1 and the bottom hole assembly 5, the bottom hole assembly 5 is prevented from rotational movement or moving sideways, but is allowed to move vertically.

The locking mechanism 4 can be any locking device that can be remotely operated or be configured to be operated by an ROV. The locking mechanism 4 lock the kelly bushing 3 to the subsea node 1 or well housing 2.

Figure 2A:
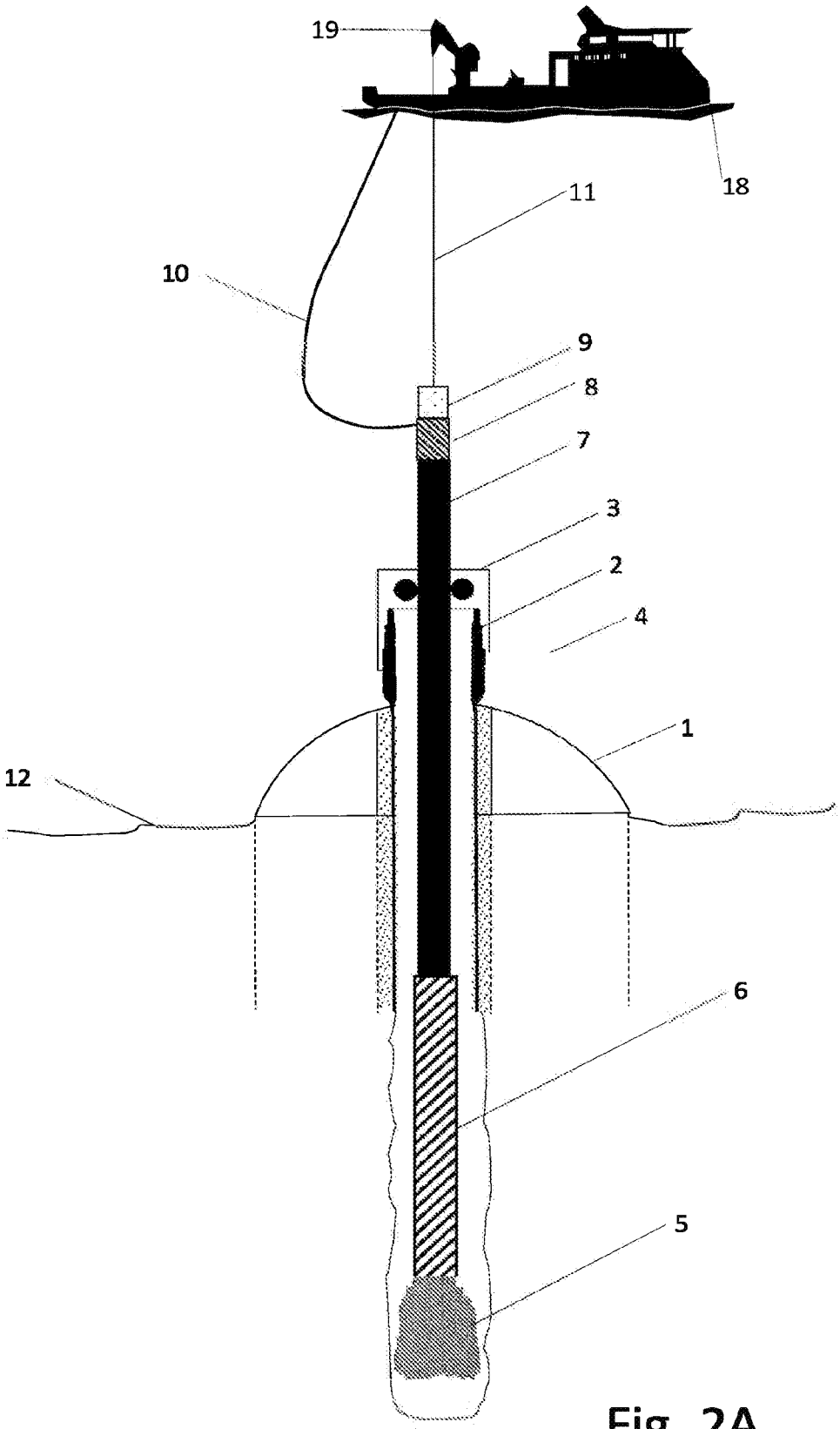

FIG. 2A-2B:

While the drilling assembly weight is set down, a fluid is pumped through a hose 10 into the side entry sub 8 down the kelly string or non-rotating drill string 7 in order to drive the drilling motor 6 that spins the drill bit. The fluid can be provided from the vessel 18 or a fluid reservoir on the sea bed. The drill bit of the BHA 5 can be driven hydraulically from a high volume pump (not shown) on the vessel 18 (FIG. 2A).

Figure 2B:
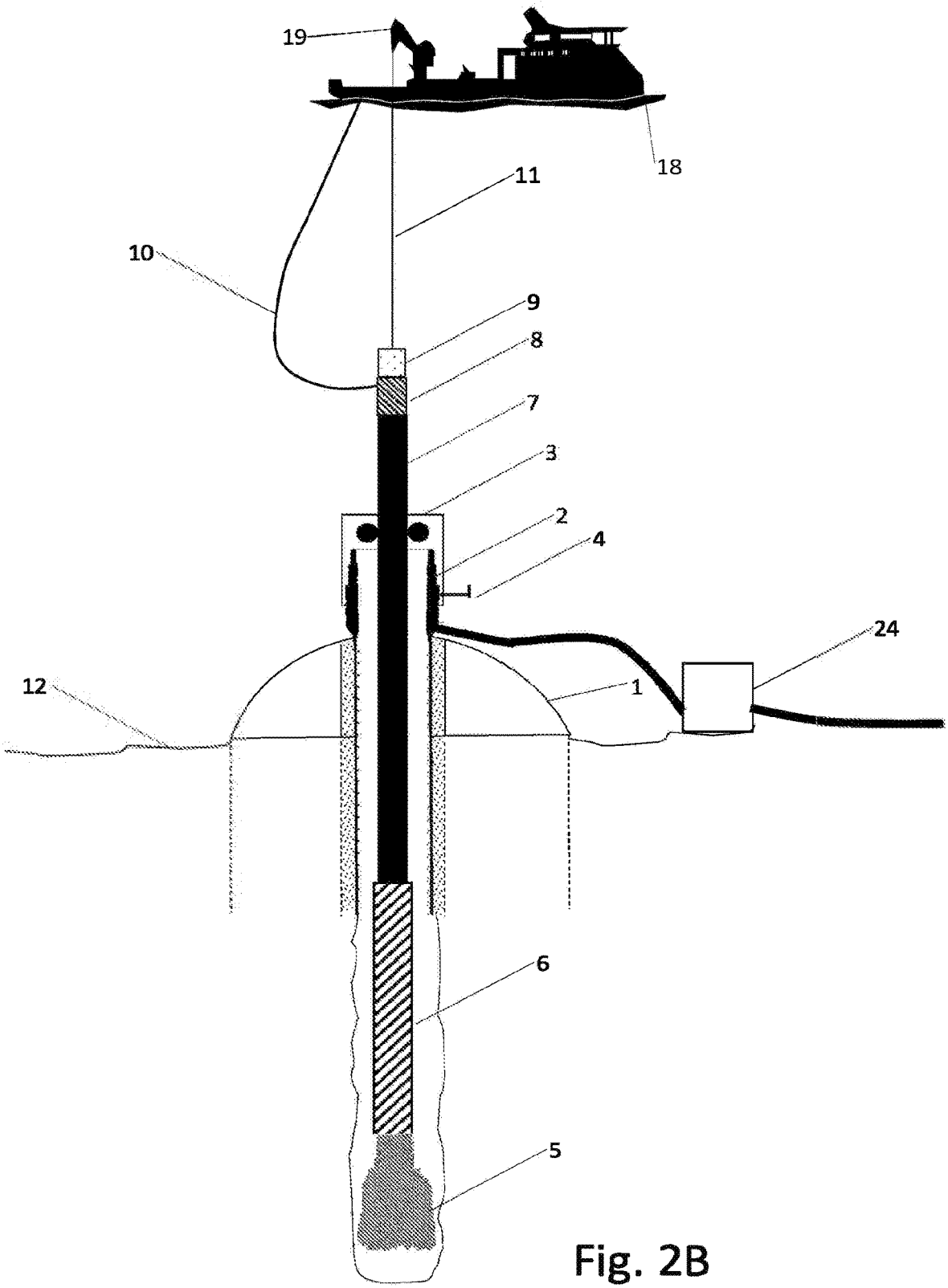
Figure 3:
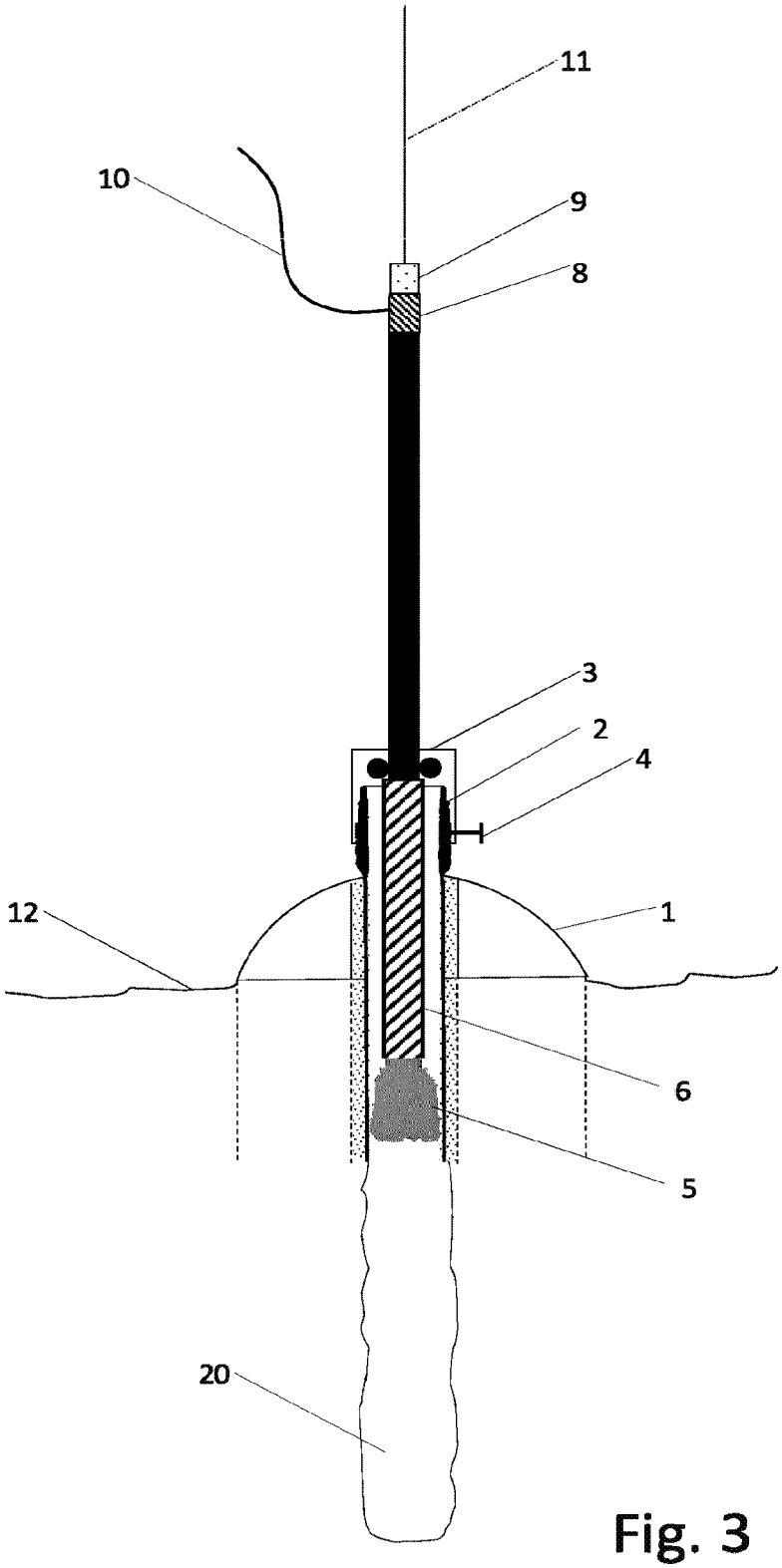

A pump 24 for drill cutting removal can be used for the circulation of the fluid. The pump can be positioned on the seabed 12 as shown in FIG. 2B.

The hose 10 can be, but is not limited to, for example a black eagle hose, a coil tubing or any flexible hosing. The fluid can be any drilling fluid.

The reactional force that is created between the bottom hole assembly (BHA) 5 and the seabed 12 under the ground will be absorbed by the kelly bushing adapter 3 and transferred via the low pressure housing (LPH) 2 to the subsea node 1.

Drill cuttings returns are escaping through cement return ports on the LPH 2 with or without a drill cutting disposal pump system 24.

FIG. 3:

Once the total depth is reached, the drilling assembly will be pulled back using the cable 11 of the hoisting mechanism 19 on the vessel 18. The hoisting mechanism can be a crane or winch.

When the drilling motor 6 reaches the kelly bushing adapter 3, or any other catch device if used, the kelly bushing adapter 3 will be unlocked by opening the locking mechanism 4.

Figure 4:
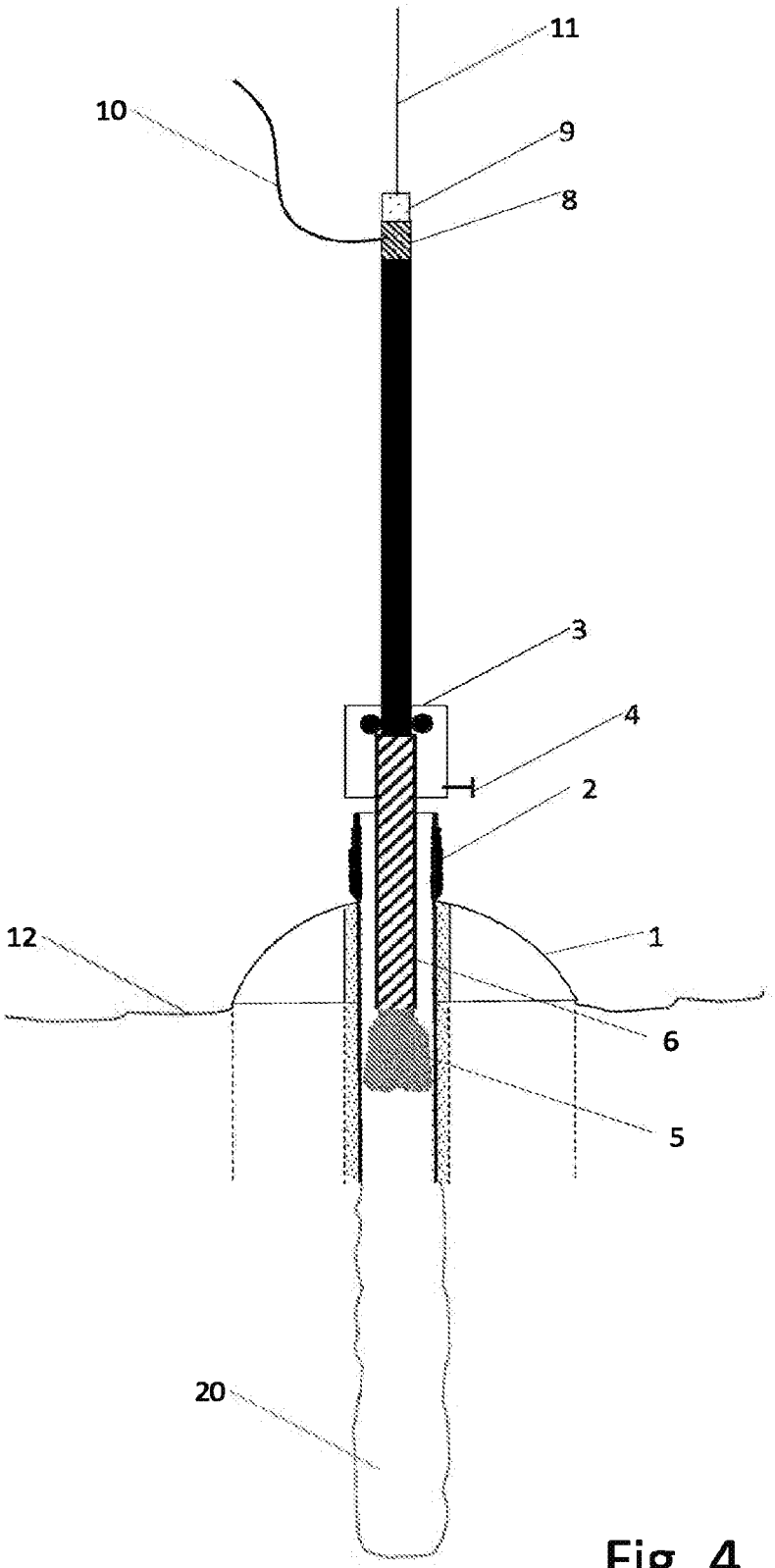
Figure 5:
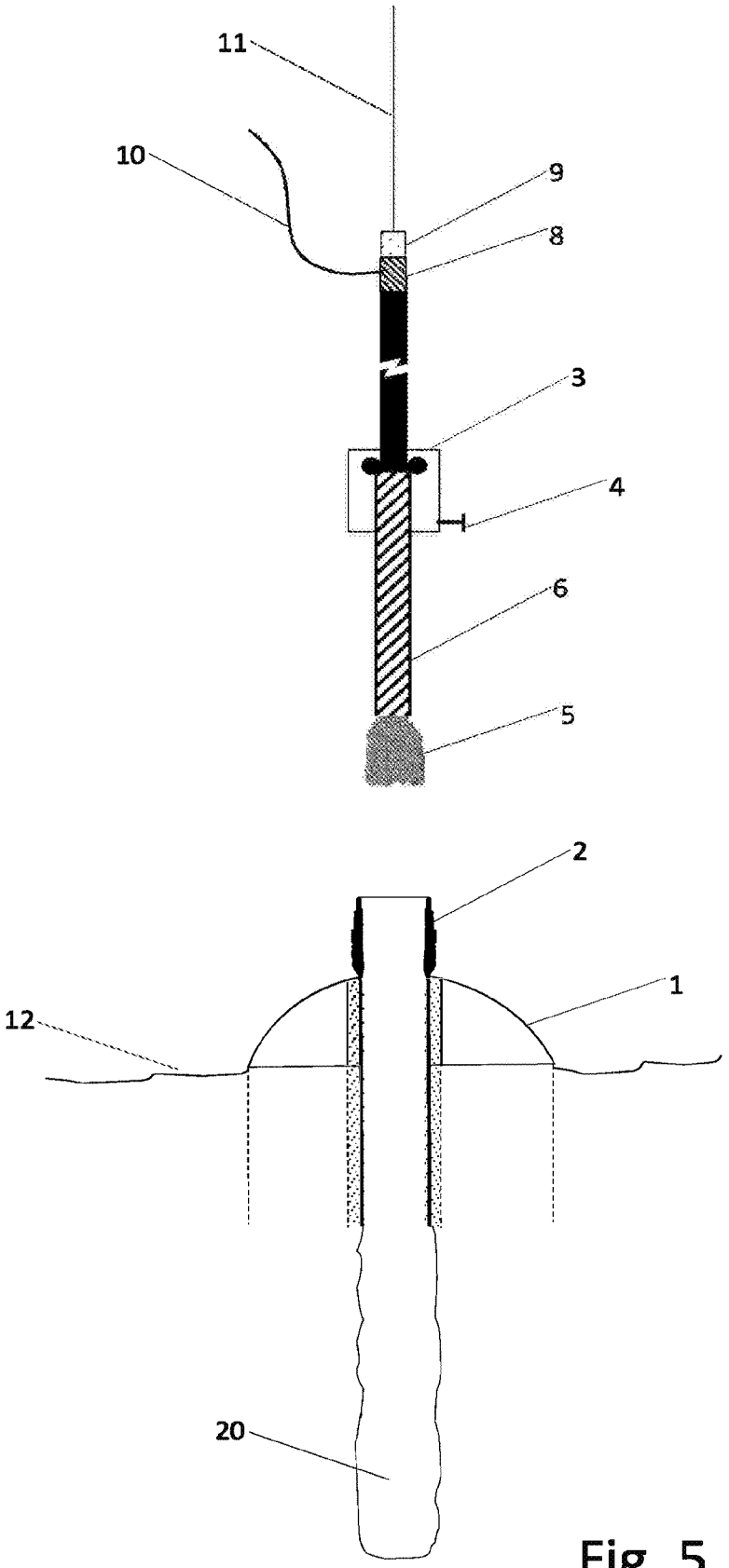
Figure 6:
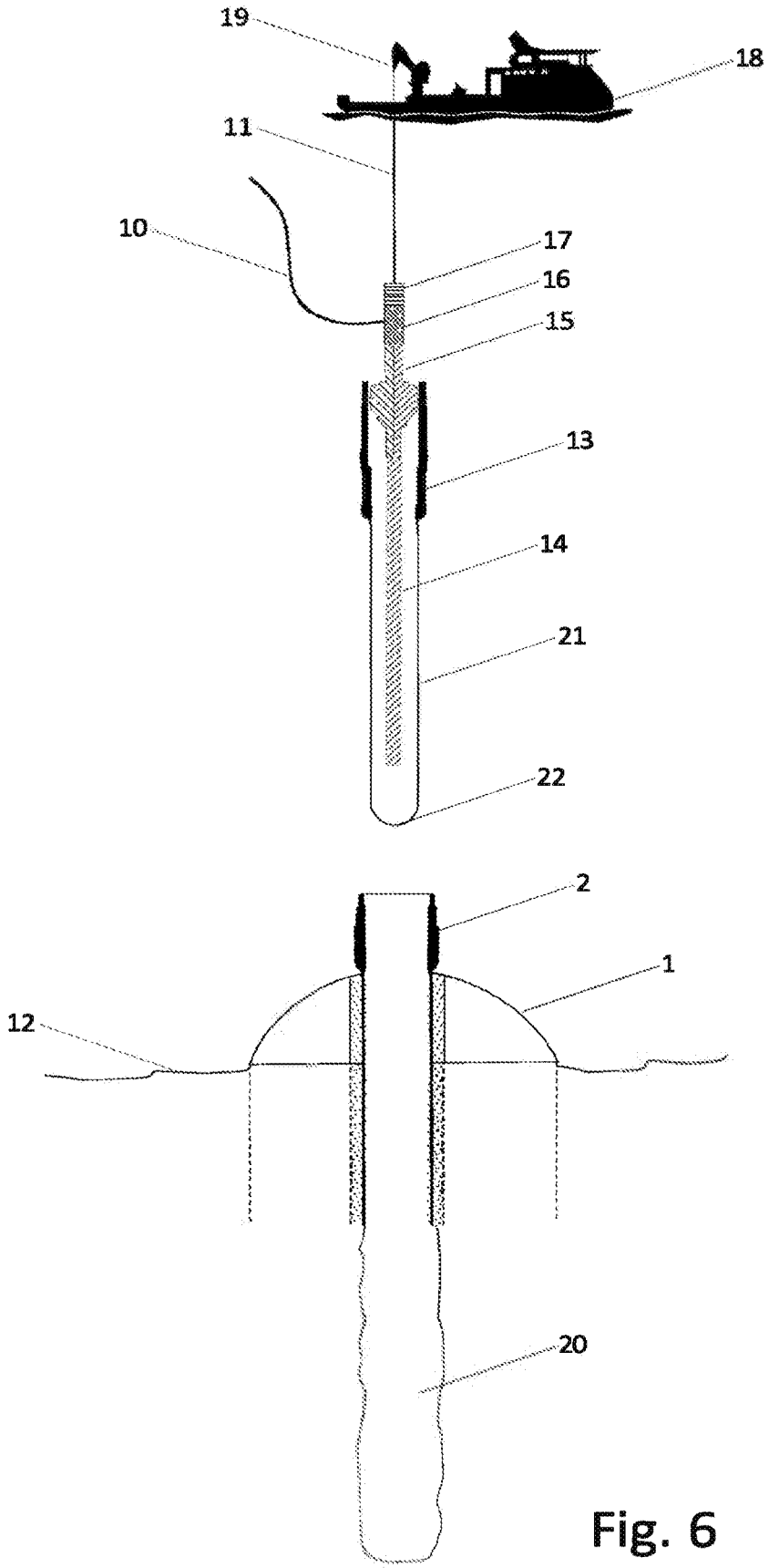
FIG. 6-10 illustrate a casing running and cementing method according to the present invention.

FIG. 4:

When the kelly bushing adapter 3 is unsecured, the whole drilling assembly will be pulled up. On FIG. 4, the kelly bushing adapter 3 is attached to the bottom hole assembly 5. When the locking mechanism 4 is unlocked, the kelly bushing adapter 3 is released from the subsea node 1 or the well housing 2.

However, in another embodiment, the kelly bushing adapter 3 can be part of the subsea node assembly. In this embodiment, the kelly bushing adapter 3 will remain on the seabed when the locking mechanism 4 is unlocked, while the bottom hole assembly is raised to the vessel.

FIG. 5:

The whole drilling assembly is then pulled to the water surface by pulling back on the cable 11 leaving the drilled well hole/borehole 20 ready for running a surface casing assembly.

FIG. 6:

The surface casing assembly is usually prepared onshore into one unit and comprises: a high pressure housing (HPH) 13 and a surface casing 21 with a check valve 22, a HPH running tool 15, a cement stinger 14, a side entry sub 16 with a swivel and a lifting sub 17.

The hose 10 from the vessel 18 is connected to the side entry sub 16.

The whole surface casing assembly is dispatched from the vessel 18 and lowered down on the wire 11 of the vessel crane 19.

FIG. 7A-7B:

The surface casing assembly is stabbed into the LPH 2 and run in the hole 20 on the wire 11. Finally, the HPH 13 latches and locks into the LPH 2.

Figure 7A:
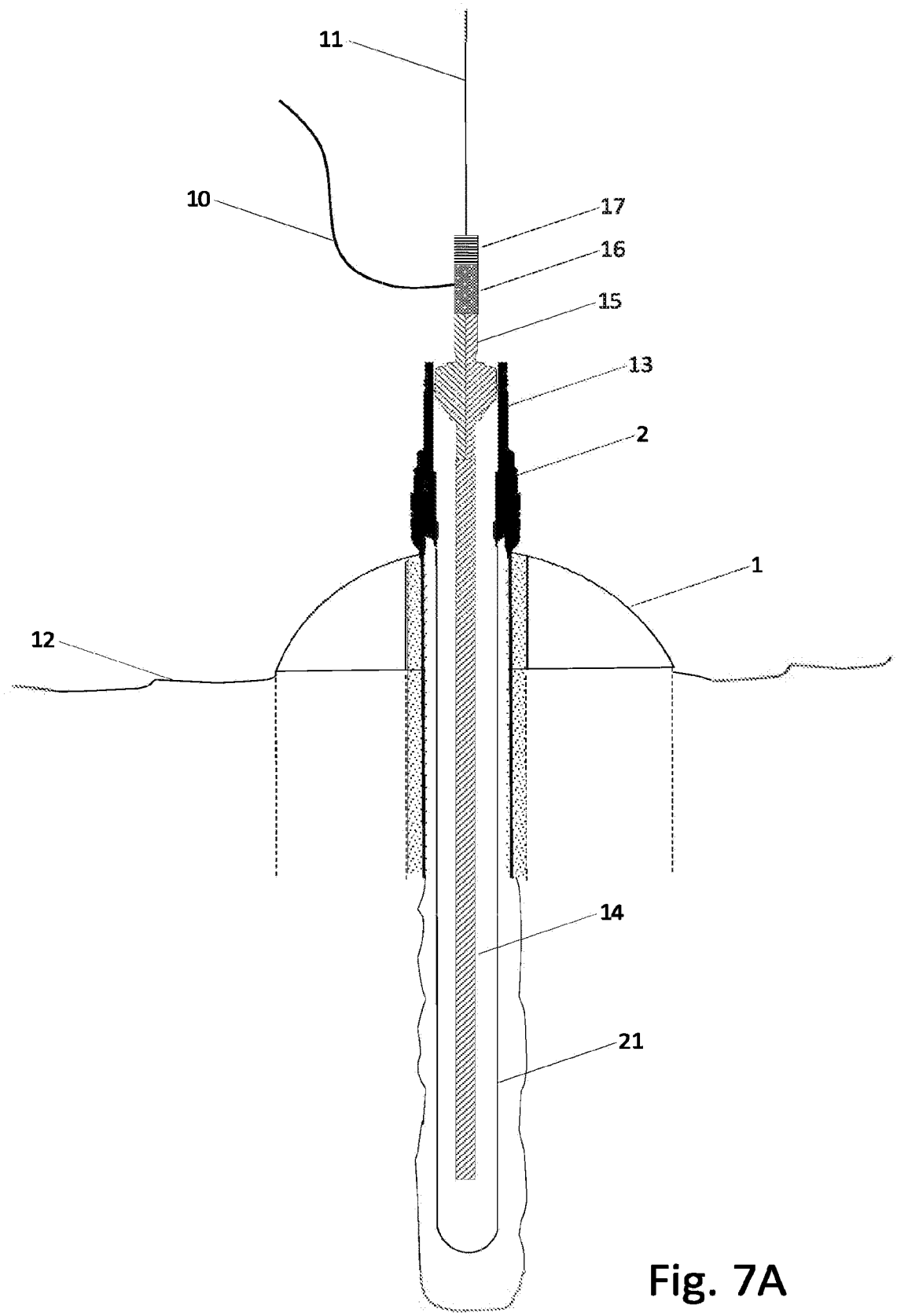

Under the running-in step, circulation of seawater or other suitable fluid in the well hole 20 can be done using a pump on the vessel 18 (FIG. 7A), down the hose 10, through the side entry sub 16 and through the HPH running tool 15.

Figure 7B:
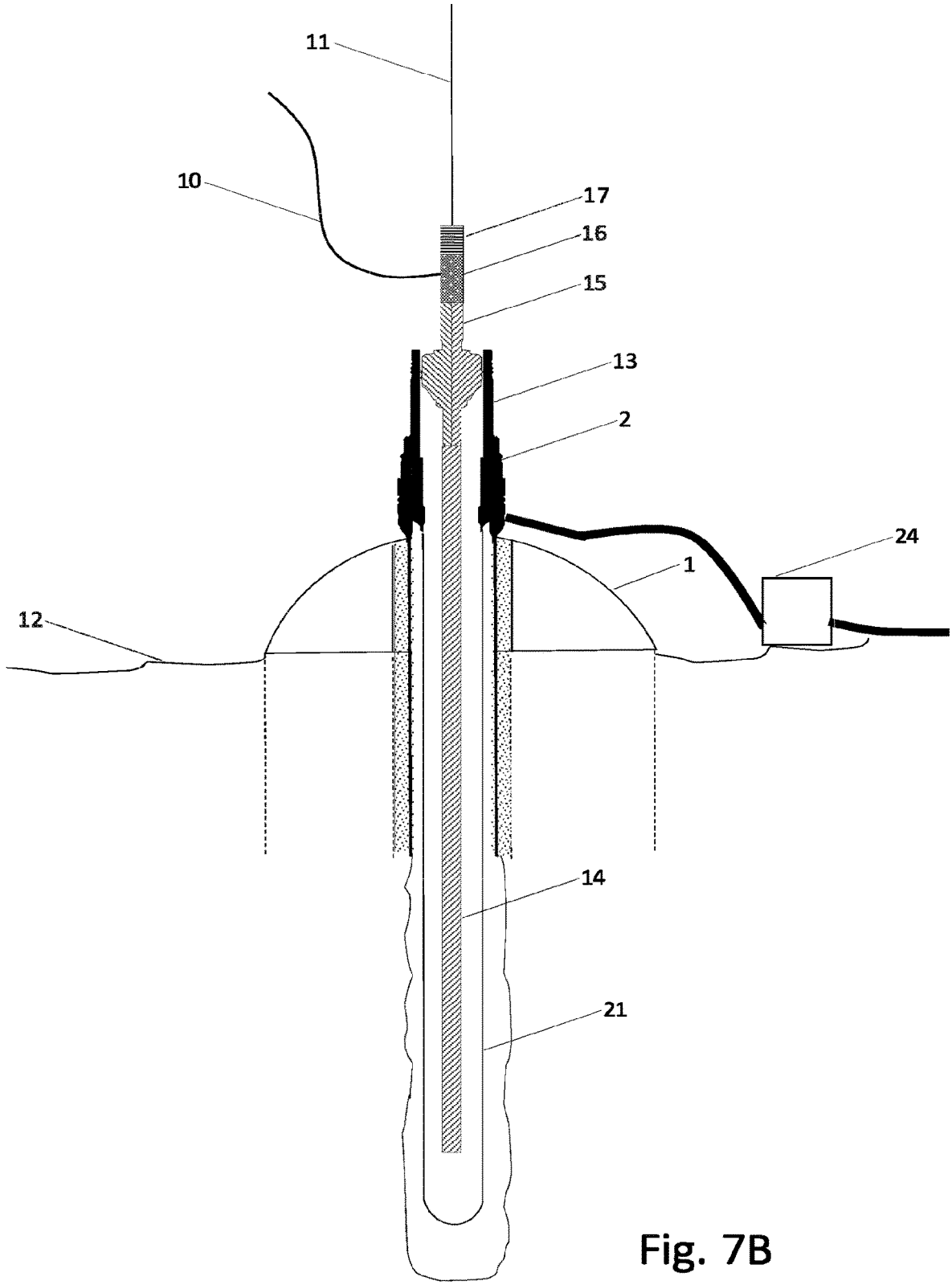
Figure 8:
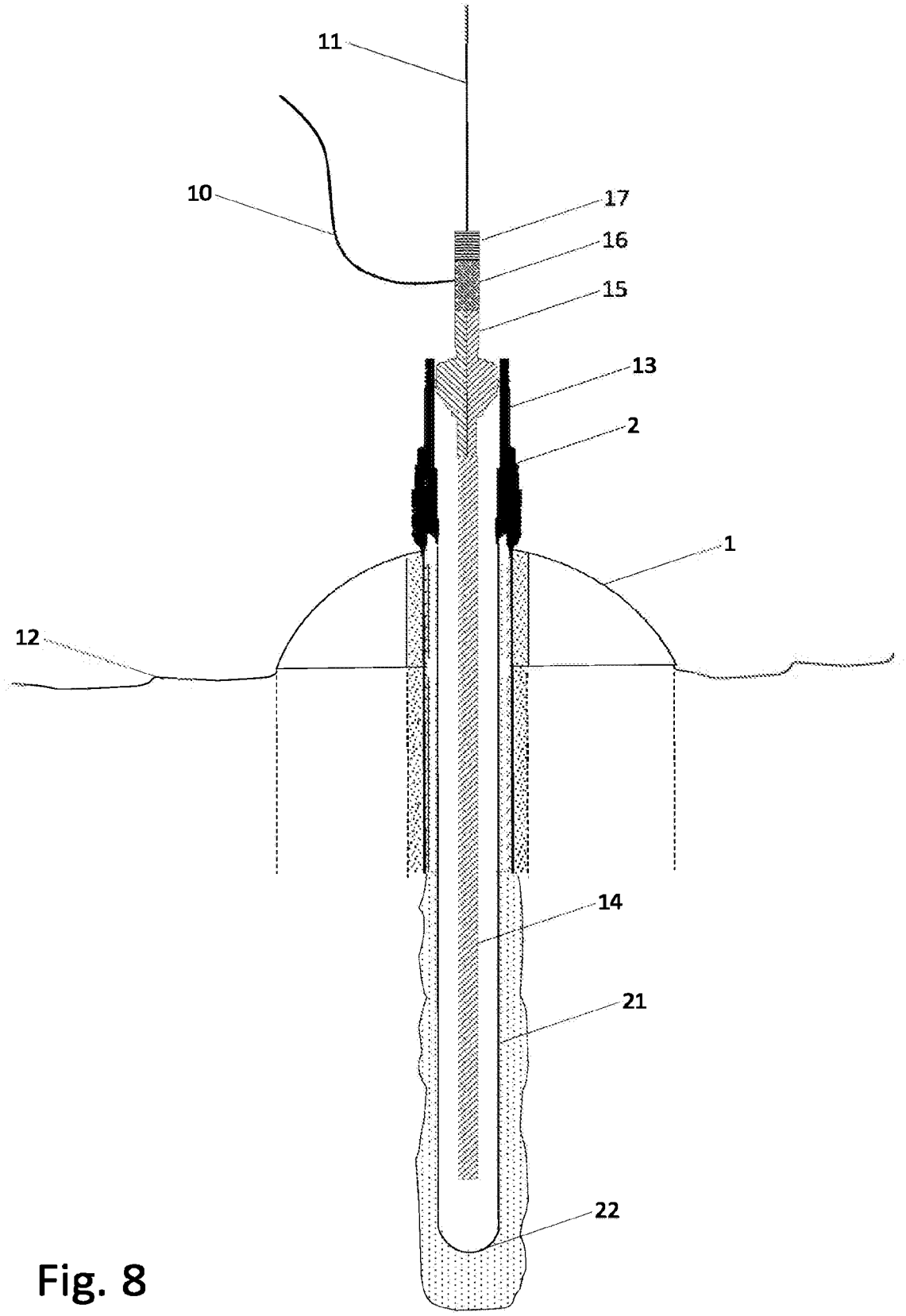
Figure 9:
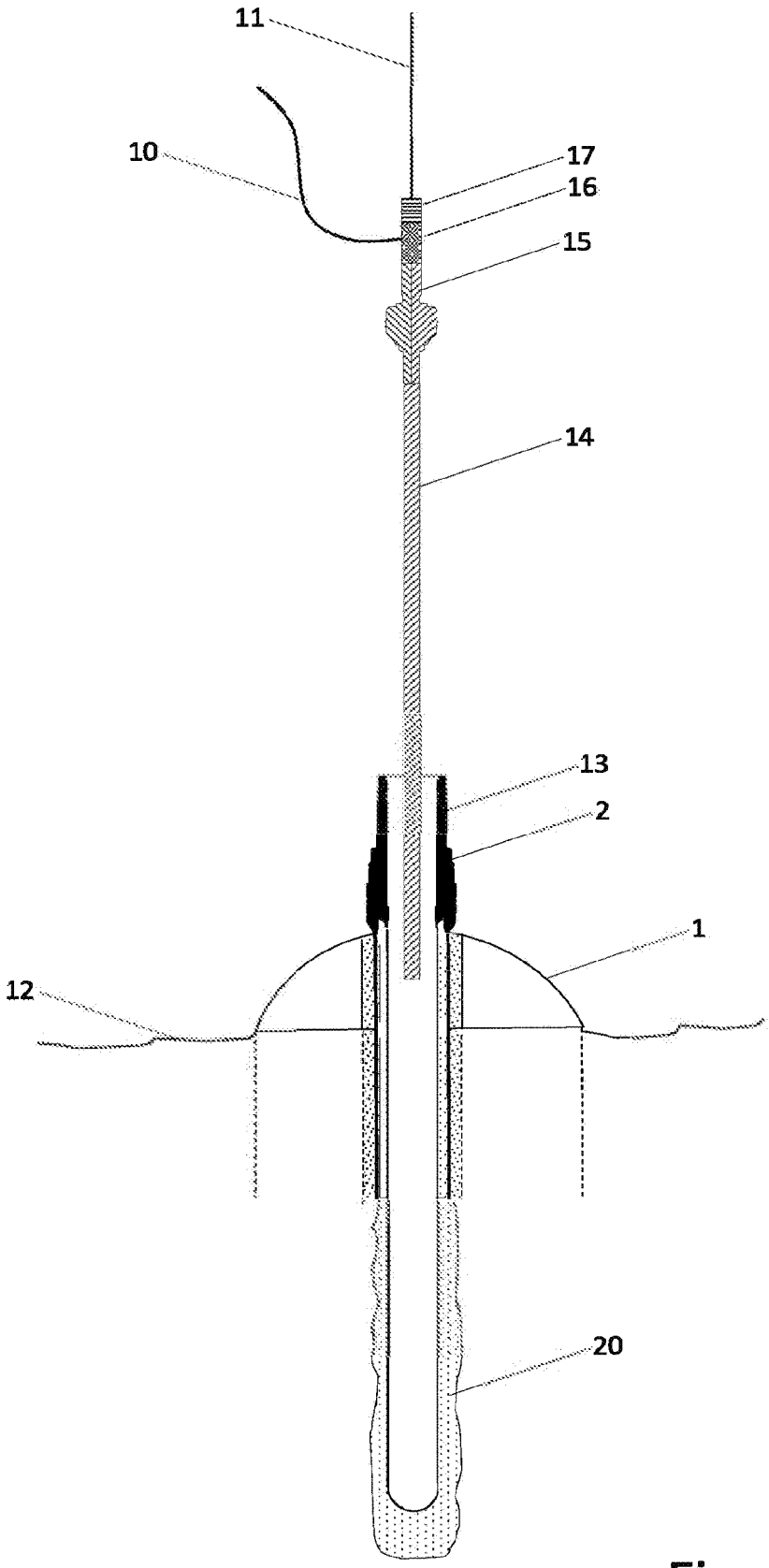
Figure 10:
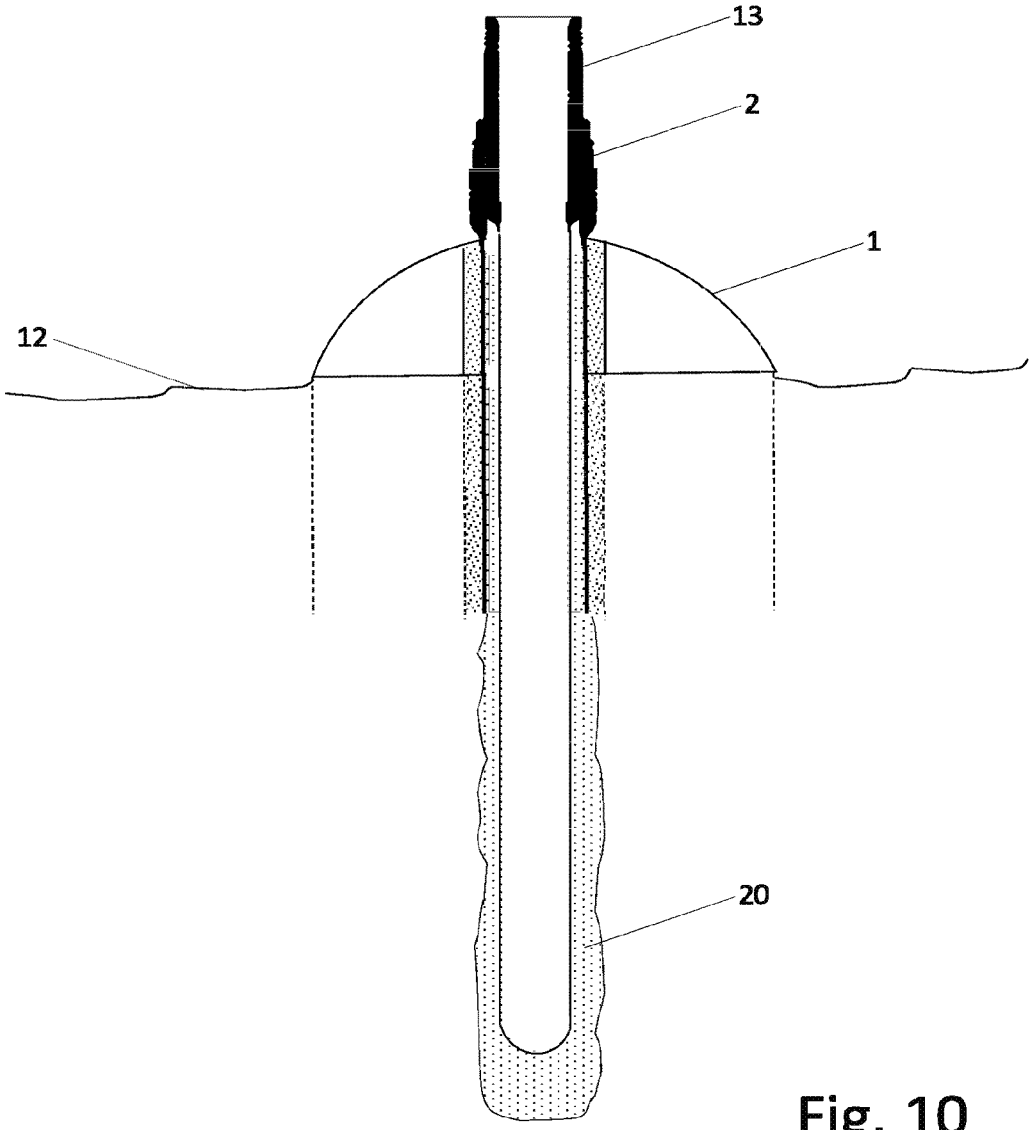

Alternatively, the pump 24 on the seabed can be used for the circulation of the seawater or the suitable fluid through the well hole 20 (FIG. 7B).

FIG. 8:

The surface casing 21 is cemented in place by pumping cement from the vessel 18, through the hose 10, into the side entry sub 16, through the HPH running tool 15 and down the cement stinger 14.

Cement returns are coming back out through the check valve 22, along outside of the surface casing assembly, and finally the cement returns are flown out through the ports in the LPH 2.

FIG. 9:

The HPH running tool 15 is released and then pulled out of the hole 20 together with the lifting sub 17, the side entry sub 16 and the cement stinger 14 using the vessel crane wire 11.

FIG. 10:

Left on the seabed 12 is a well 20 ready for a floating drilling unit to latch a BOP on to the HPH or wellhead 13.

Finally, the vessel 18 can move to a next well to be made.

It is not compulsory to remove the complete bottom hole assembly 5 from the well 20. In some situations, parts of or the complete bottom hole assembly is sacrificed in the well. In these situations, the cable 11 between the bottom hole assembly 5 and the vessel 18 is cut and the vessel can prepare to drill a new well and/or move to a new location.

In some occasions, a special kelly bushing has to be made if a kelly bushing, that is longer than what the vessel 18 can handle, is needed. Separate pipe sections or lengths can thus be connected together at or on the vessel 18, for example while running all this into the sea. For about a 50 meters hole, potentially a one piece pipe can be used, as mentioned before.

Depending on the length, the surface casing can be deployed as one assembly, if not it can be made up on the vessel 18 and then run into the sea, similar to what is done on a drilling rig.

The weight on the drill bit can be adjusted by a hive compensated crane on the vessel 18. This means that the crane 19 can have some hive compensating equipment thereon.

The total string weight should be configured to give sufficient weight to the bit in order to be able to carry on and/or fulfil the operations.

If the string is not very long, the whole string can be made up onshore and deployed straight from the back deck of the vessel 18 by the crane 19.

If a deeper hole is required, the string can be built of joints in the vessel moon pool. Thus, some handling equipment should be provided by the subsea contractor.

Additional modifications, alterations and adaptations of the present invention will suggest themselves to those skilled in the art without departing from the scope of the invention as defined in the following patent claims.

The invention claimed is:

1. A method for installation of a surface casing using a vessel, the method comprising:

preparing a well casing assembly comprising a high pressure housing (HPH), the surface casing, an HPH running tool, a cement stinger, an HPH side entry sub, and an HPH lifting sub into one unit onshore or on the vessel;

connecting a hose from the vessel to the side entry sub of the well casing assembly;

dispatching the well casing assembly from the vessel;

lowering the well casing assembly by means of a crane or winch on the vessel;

stabbing the well casing assembly into a low pressure housing and running the well casing assembly into a borehole supported by a wire;

latching and locking the HPH of the well casing assembly into the low pressure housing;

cementing the surface casing in place by pumping cement from the vessel, through the hose, into the side entry sub, through the HPH running tool and down and out of the cement stinger;

releasing the HPH running tool; and pulling out of the borehole together with the lifting sub, the side entry sub and the cement stinger by using the crane or winch on the vessel.

2. The method for installation of the surface casing using the vessel of claim 1, wherein cement returns are coming back out through a check valve of the surface casing, along an outside of the well casing assembly, and finally the cement returns go out through ports in the low pressure housing.

3. The method for installation of the surface casing using the vessel of claim 1, further comprising:

circulating a fluid through the low pressure housing.

4. The method for installation of the surface casing using the vessel of claim 3, wherein the circulating of the fluid through the low pressure housing is performed by a pump on the vessel or on a seabed.

5. The method for installation of the surface casing using the vessel of claim 3, wherein the fluid is seawater.

6. The method for installation of the surface casing using the vessel of claim 1, further comprising:

causing the HPH to remain coupled to the low pressure housing and positioned to be coupled to a blowout preventer.

7. A system for installation of a surface casing using a vessel, the system comprising:

a surface casing assembly comprising a high pressure housing (HPH), the surface casing, an HPH running tool, a cement stinger, an HPH side entry sub, and an HPH lifting sub, wherein the surface casing assembly is configured to be dispatched from the vessel and then lowered down on a wire of a crane on the vessel and is further configured to be stabbed into a subsea node with a low pressure housing and to be run into a borehole on the wire; and a hose from the vessel connected to the HPH side entry sub of the surface casing assembly;

wherein the HPH of the surface casing assembly is configured to be locked into the low pressure housing;

wherein the cement stinger is configured to cement the surface casing in place in the borehole by means of a pump configured to pump cement from the vessel, through the hose, into the HPH side entry sub and through the HPH running tool; and wherein the HPH running tool is configured to be released and pulled out of the borehole together with the lifting sub, the HPH side entry sub and the cement stinger by using the wire of the crane on the vessel.

8. The system for installation of the surface casing using the vessel of claim 7, further comprising:

a check valve downstream of the cement stinger.

9. The system for installation of the surface casing using the vessel of claim 8, wherein the cement is configured to flow through the check valve and along an outside of the surface casing assembly.

10. The system for installation of the surface casing using the vessel of claim 9, further comprising:

ports formed in the low pressure housing configured to permit flow of the cement after flowing through the check valve.

11. The system for installation of the surface casing using the vessel of claim 7, wherein the hose is configured to carry a fluid to be circulated through the low pressure housing.

12. The system for installation of the surface casing using the vessel of claim 11, wherein the fluid is seawater.

13. The system for installation of the surface casing using the vessel of claim 11, further comprising:

a second pump positioned on a seabed to circulate the fluid.

14. The system for installation of the surface casing using the vessel of claim 7, wherein the surface casing assembly is assembled at an onshore location.

15. A system for installation of one or more wellbore components using a vessel, the system comprising:

a high pressure housing (HPH);

a surface casing coupled to the HPH;

an HPH running tool coupled to the HPH;

a cement stinger coupled to the HPH running tool and extending through at least part of the surface casing;

an HPH side entry sub coupled to the HPH running tool; and an HPH lifting sub coupled to the HPH side entry sub;

a hose from the vessel connected to the HPH side entry sub; and a pump coupled to the hose;

wherein the HPH is configured to be locked into a low pressure housing coupled to a borehole, the cement stinger is configured to receive cement supplied by the pump, and the HPH running tool is configured to be released and pulled out of the borehole together with the lifting sub, the HPH side entry sub, and the cement stinger.

16. The system for installation of one or more wellbore components using a vessel of claim 15, wherein the HPH, the surface casing, the HPH running tool, the cement stinger, the HPH side entry sub, and the HPH lifting sub form a surface casing assembly.

17. The system for installation of one or more wellbore components using a vessel of claim 15, further comprising:

a check valve coupled to the surface casing, the check valve configured to permit flow of the cement out of the surface casing.

18. The system for installation of one or more wellbore components using a vessel of claim 17, further comprising:

one or more ports formed in the low pressure housing configured to receive the cement after passing through the check valve.

* * * * *